US009840019B2

(12) United States Patent
Tolliver et al.

(10) Patent No.: US 9,840,019 B2
(45) Date of Patent: Dec. 12, 2017

(54) WOOD CUTTING BLADE WITH ADJUSTMENT LEGS AND BLADE POSITIONING ASSEMBLY

(71) Applicant: THE KINETIC CO., INC., Greendale, WI (US)

(72) Inventors: Runyon McClain Tolliver, Waterford, WI (US); Paul Edward Lewandowski, Muskego, WI (US)

(73) Assignee: THE KINETIC CO., INC., Muskego, WI (US)

( * ) Notice: Subject to any disclaimer, the term of this patent is extended or adjusted under 35 U.S.C. 154(b) by 265 days.

(21) Appl. No.: 14/523,227

(22) Filed: Oct. 24, 2014

(65) Prior Publication Data

US 2015/0114200 A1 Apr. 30, 2015

Related U.S. Application Data

(60) Provisional application No. 61/894,966, filed on Oct. 24, 2013.

(51) Int. Cl.

| | |
|---|---|
| ***B26D 7/26*** | (2006.01) |
| ***B26D 1/00*** | (2006.01) |
| ***B27L 11/00*** | (2006.01) |
| *B26D 3/28* | (2006.01) |

(52) U.S. Cl.

CPC ..... *B26D 7/2628* (2013.01); *B26D 1/0006* (2013.01); *B27L 11/005* (2013.01); *B26D 3/28* (2013.01); *Y10T 83/9457* (2015.04); *Y10T 83/9488* (2015.04)

(58) Field of Classification Search

CPC ..... B26D 7/2628; B26D 3/08; B26D 2001/0053; B26D 1/0006; B26D 73/28; B27L 11/005; Y10T 83/9457; Y10T 83/9488

USPC ..... 83/699, 667, 684, 698, 700, 652–657, 83/682, 685–691, 620, 697, 694, 923, 83/835, 699.15; 241/291, 300

See application file for complete search history.

(56) References Cited

U.S. PATENT DOCUMENTS

| | | | | |
|---|---|---|---|---|
| 596,530 A * | 1/1898 | McCoy | ..... | B23D 35/002 30/349 |
| 700,053 A * | 5/1902 | Kendell | ..... | B26D 7/2614 30/329 |
| 1,195,538 A * | 8/1916 | Wadhams | ..... | B26D 7/016 144/162.1 |

(Continued)

*Primary Examiner* — Ghassem Alie

(74) *Attorney, Agent, or Firm* — Joseph S. Heino; James Earl Lowe, Jr.

(57) ABSTRACT

A blade and assembly provides for a blade that has a front beveled cutting edge and at least two recesses defined within the back, or non-cutting edge, of the blade. A substantially cylindrical cavity or bore extends inwardly into the blade from each recess, the bores being defined in planes that are parallel to the top and bottom surfaces of the blade. A plurality of "T-shaped" legs is provided, each leg having a cross bar or "foot" that is secured at one end of a rod. In the preferred embodiment, three such legs are used, although the present invention is not limited to that number. The rod of each leg is used for insertion into a blade bore. Means for fixing the position of the rod within the blade bore is also provided. This allows the blade to be properly positioned within the holder thereby compensating for blade wear.

6 Claims, 3 Drawing Sheets

(56) References Cited

U.S. PATENT DOCUMENTS

| | | | | | |
|---|---|---|---|---|---|
| 1,294,638 | A * | 2/1919 | Draper | B27G 13/04 | 144/225 |
| 2,178,710 | A * | 11/1939 | Valiquette | B26D 7/2614 | 30/349 |
| 2,540,836 | A * | 2/1951 | Seybold | B23D 35/008 | 29/243 |
| 2,858,886 | A * | 11/1958 | Rivera | B23D 35/004 | 74/89.17 |
| 3,148,575 | A * | 9/1964 | Thyng | B26D 7/2628 | 83/699.11 |
| 3,233,494 | A * | 2/1966 | Rupp | B26D 7/2628 | 83/640 |
| 4,066,111 | A * | 1/1978 | Klebe, Jr. | B27G 13/04 | 144/225 |
| 4,250,786 | A * | 2/1981 | Bleich | B26F 1/44 | 83/667 |
| 4,896,019 | A * | 1/1990 | Hyun | B23K 3/025 | 219/228 |
| 5,255,588 | A * | 10/1993 | Foos | B26D 3/085 | 83/449 |
| 2006/0283303 | A1* | 12/2006 | Smith | B23D 61/065 | 83/835 |
| 2014/0027552 | A1* | 1/2014 | Hinchliff | B27G 13/00 | 241/300 |

* cited by examiner

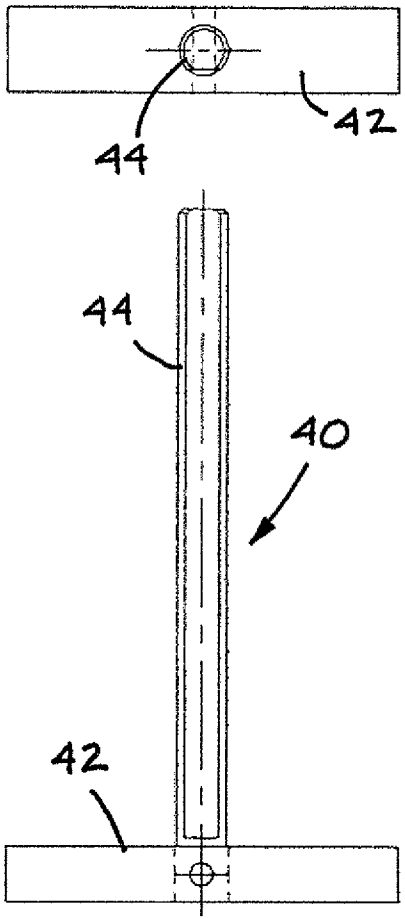
FIG. 5B
FIG. 5A
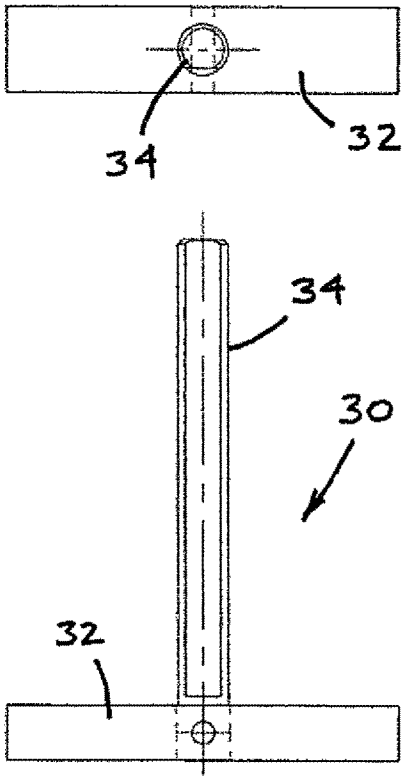
FIG. 4B
FIG. 4A
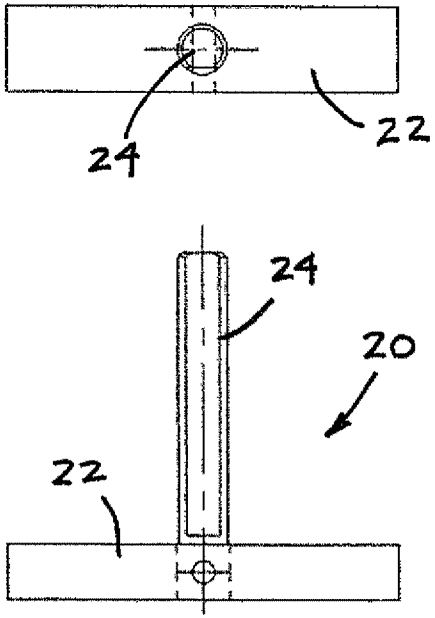
FIG. 3B
FIG. 3A

WOOD CUTTING BLADE WITH ADJUSTMENT LEGS AND BLADE POSITIONING ASSEMBLY

This application claims the benefit and priority of U.S. Provisional Patent Application No. 61/894,966 filed Oct. 24, 2013.

FIELD OF THE INVENTION

The present invention relates generally to the processes of wood cutting, chipping, peeling and slicing and to the beveled metal blades that are used with such processes. More specifically, the present invention relates to a beveled metal blade that has adjustment legs for use within a fixed or rotatable blade mount base or head. It also relates to a blade positioning assembly that is drawn to that combination.

BACKGROUND OF THE INVENTION

The use of beveled metal blades is well known. A fixed or rotary base or head that holds one or more blades within the base or head is also well known. Such structures will be collectively referred to herein simply as "blade holders" or a "blade holder." The blade holder typically comprises a linear aperture having a rear surface and further comprises means and structure for securely clamping the blade for use. The precise type of blade holder with which the present invention is used is not a limitation of the present invention.

One obvious problem with the use of beveled metal blades in applications where wood is processed is that the cutting edge of the blade, or blades, becomes worn or dulled over time. Indeed, such beveled blade edges become worn to the point that the process becomes inefficient, which necessarily requires re-sharpening of the bevel or complete replacement of the blade or blades.

In view of such blade wear, however, it is far more desirable and economical to remove the blade or blades from the blade holder, sharpen the beveled cutting edge or edges, and then re-secure the blade or blades within the blade holder. However, it is also well known that blade sharpening results in the loss of blade material, which serves to shorten the depth of the blade. Obviously, re-insertion of the shortened blade into the blade holder could result in a blade that will not rest against the rear surface of the holder in which case the blade is effectively too short for its intended use. While shims and spacer blocks can be inserted behind the blade, or melted babitt metal can be poured behind the blade, it is difficult to properly position the blade using the former methods unless the shims or blocks exactly match the amount of blade material lost during the sharpening process.

Accordingly, it is an object of the present invention to provide a means for compensating for the metal material that is lost during the process of sharpening of the beveled blade edge while also allowing the blade to continue to be used as intended. It is another object to provide such a means that can be used easily and quickly, that uses a minimal number of steps and tools to do so and that allows the blade to have an extended useful life even though the metal cutting blade is shortened during the sharpening process. It is a further object to provide the structure for compensating for metal lost during the blade sharpening process that eliminates the need for shims, spacer blocks or other means that would otherwise be needed to position the blade within the blade holder.

SUMMARY OF THE INVENTION

The blade and assembly of the present invention has obtained these objects. It provides for a blade that has a front beveled cutting edge and at least two recesses defined within the back, or non-cutting edge, of the blade. It is also within the scope of the present invention to provide a back blade edge without recesses which would provide substantially the same functionality as described in this disclosure, the blade and assembly of the present invention being fully functional in such alternative embodiment.

A bore in the form of a substantially cylindrical cavity or circular aperture extends inwardly into the blade from each recess, or inwardly from the rear of the blade where no recesses are provided, the apertures having axes that are defined in planes that are parallel to first and second planar surfaces of the blade. However, the blade of the present invention is not limited to cylindrical cavities or circular apertures in this regard. A plurality of "T-shaped" legs is also provided, each leg having a cross bar or "foot" that is secured at one end of a rod. In the preferred embodiment, three such legs are used, although the present invention is not limited to that number. Further, the legs are not limited strictly to a T-shape as other shapes could be functionally adapted for use in the preferred embodiment.

The rod of each leg is used for insertion into the blade apertures, the profile of the rod substantially matching that of the bore. This allows the blade to be extended forwardly or rearwardly so as to properly position the blade within the holder. Means for fixing the position of the rod within the bore is also provided.

The foregoing and other features of the metal blade and the blade assembly of the present invention will be apparent from the detailed description that follows.

BRIEF DESCRIPTION OF THE DRAWINGS

FIGS. 3A and 3B are top and end views, respectively, of an exemplary short adjusting leg used with the blade shown in FIGS. 1 and 2.

FIGS. 4A and 4B are top and end views, respectively, of an exemplary medium adjusting leg used with the blade shown in FIGS. 1 and 2.

FIGS. 5A and 5B are top and end views, respectively, of an exemplary long adjusting leg used with the blade shown in FIGS. 1 and 2.

DETAILED DESCRIPTION

Figure 1:
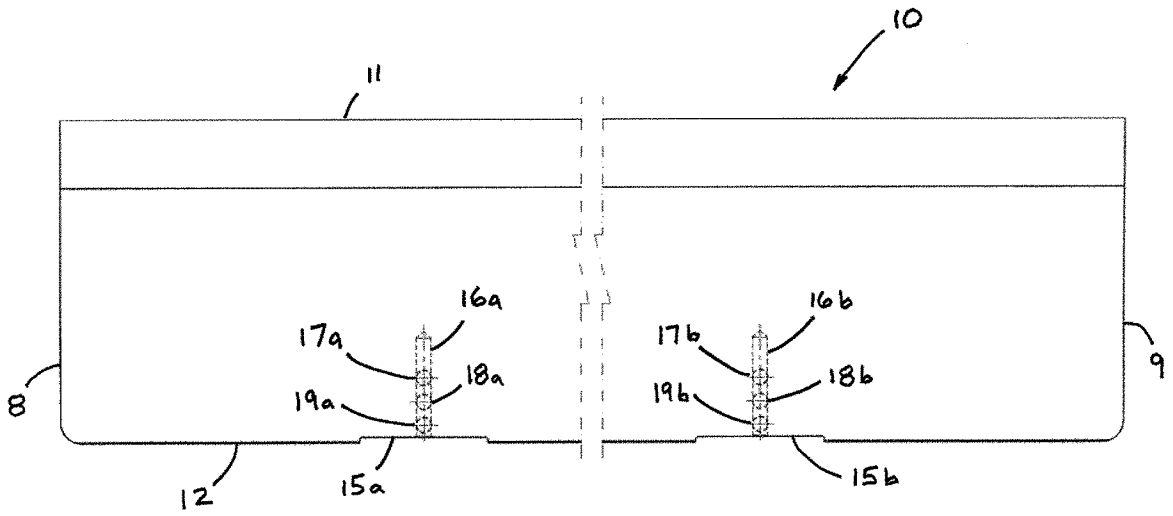
FIG. 1 is a top plan view of a metal cutting blade that is constructed in accordance with the present invention and showing the blade prior to insertion of the T-shaped legs into the blade.
Figure 2:
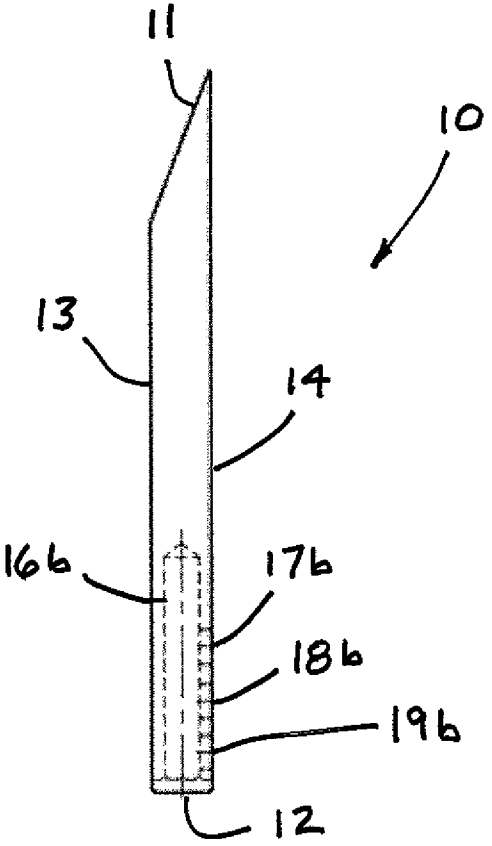
FIG. 2 is right side elevational view of the blade shown in FIG. 1.

Referring now to the drawings in detail, wherein like numbered elements refer to like elements throughout, FIGS. 1 and 2 illustrate a representative structure, generally identified 10, which is a preferred embodiment of a beveled metal blade that is fabricated in accordance with the present invention.

As shown, the blade 10 comprises a beveled front cutting edge 11 and a rear surface 12. This rear surface 12 is that portion of the blade 10 that can rest against the rear surface of the blade holder (not shown). The blade 10 is also defined by a planar top surface 13 and a planar bottom surface 14. It should be noted that the surfaces are defined as "top" and "bottom" for purposes of orientation in this detailed description and such orientations are not limitations of the present invention. For example, such surfaces could also be identified as a "first" and a "second" planar surface and still be within the scope of the present invention.

In the preferred embodiment, the rear surface 12 has at least two rectangular-shaped recesses 15*a*, 15*b*, although the recesses are not limited to that shape and the recesses could be eliminated altogether in an alternative embodiment. Extending inwardly of the blade 10 from each recess 15*a*, 15*b* is a primary bore in the form of a substantially cylindrical cavity or circular aperture 16*a*, 16*b*, respectively. In the embodiment where the recesses are eliminated, the primary bores 16*a*, 16*b* would simply extend inwardly from the rear surface 12 of the blade 10. Each primary bore or aperture 16*a*, 16*b* has an axis, the axis being substantially parallel to the planar top surface 13 and the planar bottom surface 14 of the blade 10. It is to be understood, however, that the primary apertures 16*a*, 16*b* need not be cylindrical cavities or bores and the present invention is not limited to a circular aperture structure as disclosed herein.

Accessible from the bottom surface 14 and disposed below each primary aperture 16*a*, 16*b* are a plurality of threaded secondary bores or apertures 17*a*, 17*b*, 18*a*, 18*b*, 19*a*, 19*b* which are used as points for receiving a like-threaded set screw (not shown). Each secondary bore is configured to intersect a primary bore perpendicularly. That is, each secondary bore also has an axis, such axis being substantially perpendicular to the axis of the primary bore that the secondary bore is associated with. It is also to be understood that other fastening means could be utilized in accordance with the spirit and scope of the present invention. It is also to be understood that the secondary bores 17*a*, 17*b*, 18*a*, 18*b*, 19*a*, 19*b* could also be disposed above the blade 10 and still come within the scope of the present invention, such position being equally effective in application. Further, and where the thickness of the blade 10 is relatively thin, it is also possible to align the secondary bores 17*a*, 17*b*, 18*a*, 18*b*, 19*a*, 19*b* in such a way that the bores are accessed from the ends 8, 9 of the blade 10. See FIG. 1. In this configuration, the primary bores 16*a*, 16*b* would be disposed closer to the ends 8, 9 of the blade 10.

In the preferred embodiment, a series of "T-shaped" legs are intended to be received within the primary bores 16*a*, 16*b*. It is to be understood that alternative shapes of legs could be used, such as "L-shaped" legs, "U-shaped" legs, linear posts (which would simply be the "longitudinal rods" mentioned below) and the like. All such embodiments are within the scope of the present invention provided the structure is receivable within the primary bores 16*a*, 16*b* and the need for inserting any shims or spacer blocks behind the blade or pouring melted babitt metal behind the blade is eliminated.

Referring to FIGS. 3A and 3B of the preferred embodiment, they illustrate a short T-shaped adjustment leg, generally identified 20. The short adjustment leg 20 comprises a cross-bar 22 from which a longitudinal rod 24 extends perpendicularly. The size of the rod 24 is slightly smaller than the size of the primary bores or apertures 16*a*, 16*b* such that the rod 24 can be easily received by, slid into and withdrawn from such primary bores or apertures. The cross-bar 22 of the leg 20 is dimensioned such that a portion of such cross-bar 22 fits within either of the recesses 15*a*, 15*b*.

Referring to FIGS. 4A and 4B, they similarly illustrate a medium T-shaped adjustment leg, generally identified 30. The medium adjustment leg 30 comprises a cross-bar 32 from which a longitudinal rod 34 extends perpendicularly. The size of the rod 34 is also slightly smaller than the size of the primary bores or apertures 16*a*, 16*b* such that the rod 34 can be easily received by, slid into and withdrawn from such primary bores or apertures. The cross-bar 32 of the leg 30 is dimensioned such that a portion of the cross-bar 32 fits within either of the recesses 15*a*, 15*b*.

Referring to FIGS. 5A and 5B, they illustrate a long T-shaped adjustment leg, generally identified 40. The long adjustment leg 40 comprises a cross-bar 42 from which a longitudinal rod 44 extends perpendicularly. The size of the rod 44 is slightly smaller than the size of the primary bores or apertures 16*a*, 16*b* such that the rod 44 can also be easily received by, slid into and withdrawn from such primary bores or apertures. The cross-bar 42 of the leg 40 is dimensioned such that a portion of the cross-bar 42 fits within either of the recesses 15*a*, 15*b*.

In application, the blade 10 is held within the blade holder (also not shown). When the beveled front cutting edge 11 of the blade 10 is worn to the point that it needs to be sharpened, the blade 10 is unclamped and withdrawn from the blade holder. Because sharpening decreases the depth of the blade 10, some adjustment or compensation must be made for that decrease in blade depth. In the blade 10 and assembly of the present invention, adjustment of the rods 24, 34, 44 within their respective primary bores or apertures allows the blade 10 to be positioned relative to the rear surface of the holder against which the rear surface 12 of the blade 10 would normally rest. This allows for precise adjustment of the blade 10 within the blade holder prior to clamping of the blade 10 under high pressure within the blade holder, such as between a mount base and a clamping plate, for example.

By way of specific example, and to "fine adjust" the blade 10 relative to blade holder, a short adjustment leg 20 can first be inserted into each of the primary apertures 16*a*, 16*b* to a depth as is necessary. In this way, the cross-bar 22 need not be received within the recesses 15*a*, 15*b* or positioned within them. The rod 24 of the leg 20 can then be secured in a position within the primary bores or apertures 16*a*, 16*b* to match the blade depth that needs to be compensated for. This is accomplished by using the secondary threaded secondary bores or apertures 17*a*, 17*b*, 18*a*, 18*b*, 19*a*, 19*b* as points for receiving like-threaded set screws (also not shown) which hold the rods 24, 34, 44 in place. Again, it is to be noted that the fastening means for securing the rods 24, 34, 44 within the primary bores or apertures 16*a*, 16*b* is not limited to threaded set screws and like-threaded apertures 17*a*, 17*b*, 18*a*, 18*b*, 19*a*, 19*b*. Other fastening or fixing means are contemplated to be within the scope of this invention. The embodiment shown is only one alternative embodiment that could be configured in accordance with the present invention.

Throughout the useful life of the blade 10, the other legs 30, 40 can be used in similar fashion to further extend the beveled front cutting edge 11 of the blade 10 into its desired or required position. In this fashion, the blade 10 can be used in combination with the adjustment legs 20, 30, 40 throughout the useful life of the blade 10 to move the blade 10 from a first length of about seven and one-half inches all the way down to a second length of just under four inches, although an almost infinite variety of blade depths could be created using the device and assembly of the present invention, and the present invention is not so limited in this regard. In the process, incremental movement and positioning of the blade 10 can be finely and precisely adjusted as is desired or required by the particular cutting application in view of blade wear.

We claim:

1. A wood cutting blade comprising:

a beveled front cutting edge;

a rear end surface opposite the beveled front cutting edge;

a planar top surface;

a planar bottom surface opposite the planar top surface;

a primary bore extending inwardly of the blade from the rear surface;

a T-shaped leg comprising a cross-bar and a longitudinal rod that extends perpendicularly from the cross-bar, the rod being receivable and slidable within the primary bore, and the rod extending outwardly from the rear surface and the crossbar being spaced apart from the rear surface, and securing means for securing the leg within the primary bore, wherein there are a plurality of such primary bores spaced apart across the rear surface of the blade.

2. The wood cutting blade of claim 1 wherein the blade includes a plurality of such T-shaped legs, with at least one of said plurality of T-shaped legs having a rod of a different length than another T-shaped leg.

3. The wood cutting blade of claim 1 wherein the T-shaped leg cross-bar is not a head of a bolt or the head of a screw.

4. A wood cutting blade comprising:

a beveled front cutting edge; a rear end surface opposite the beveled front cutting edge;

a planar top surface;

a planar bottom surface opposite the planar top surface;

a plurality of primary bores spaced apart across the rear surface of the blade, each primary bore extending inwardly of the blade from the rear surface;

a plurality of T-shaped legs, each leg comprising a cross-bar and a longitudinal rod that extends perpendicularly from the cross-bar, each rod being receivable and slidable within a respective one of the primary bore, and the rod extending outwardly from the rear surface and the crossbar being spaced apart from the rear surface, and securing means for securing each leg within each primary bore, the securing means comprising a plurality of spaced apart threaded secondary bores angled relative to the primary bore and intersecting the primary bore at spaced apart locations along its length, and a set screw adapted to be received within the secondary bore and adapted to engage the leg.

5. The wood cutting blade of claim 4 wherein the blade includes a plurality of T-shaped legs, with at least one of said plurality of T-shaped legs having a rod of a different length than another T-shaped leg.

6. The wood cutting blade of claim 4 wherein the T-shaped leg cross-bar is not a head of a bolt or the head of a screw.

* * * * *